US005307823A

United States Patent [19]

Jones et al.

[11] Patent Number: 5,307,823

[45] Date of Patent: May 3, 1994

[54] ROD OF SMOKING MATERIAL AND CIGARETTES MADE THEREFROM

[75] Inventors: David H. Jones, Leigh-on-Sea; Jerzy Kijowski, Billericay, both of England

[73] Assignee: Rothmans International Services Limited, United Kingdom

[21] Appl. No.: 945,876

[22] Filed: Sep. 17, 1992

[30] Foreign Application Priority Data

Sep. 19, 1991 [GB] United Kingdom ..... 9120060

[51] Int. Cl.[5] ..... A24D 1/02

[52] U.S. Cl. ..... 131/331; 131/342; 131/365

[58] Field of Search ..... 131/331, 342, 365, 336, 131/361

[56] References Cited

U.S. PATENT DOCUMENTS

| | | | |
|---|---|---|---|
| 3,640,285 | 2/1972 | Briskin | 131/365 |
| 3,744,496 | 7/1973 | McCarty et al. | 131/342 |
| 4,924,888 | 5/1990 | Perfetti et al. | 131/331 X |

*Primary Examiner*—William H. Grieb

*Attorney, Agent, or Firm*—Diller, Ramik & Wight

[57] ABSTRACT

A rod of smoking material having an inner wrapper of sidestream reducing paper containing carbon as part of its total filler content and an outer overwrapping cigarette paper.

11 Claims, 1 Drawing Sheet

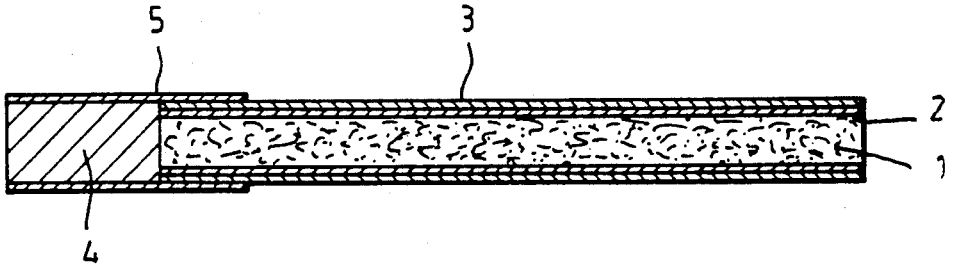
5
3
2
1
4

ROD OF SMOKING MATERIAL AND CIGARETTES MADE THEREFROM

This invention relates to a rod of smoking material and a cigarette produced therefrom that gives reduced levels of sidestream smoke whilst maintaining acceptable smoke taste, puff number and tactile characteristics.

According to the present invention a rod of smoking material has an inner wrapper of sidestream reducing paper containing carbon as part of its total filler content and an outer overwrapping cigarette paper.

The outer wrapping can be a conventional cigarette paper or a low sidestream cigarette paper made and supplied by, for example Ecusta (a Division of P.H. Glatfelter Co.), Papeteries de Mauduit, or Kimberly-Clark Corporation.

The inner and outer wrappers can be of different porosity and it has been found that unexpected results for the burn rates of cigarettes with this type of construction can be obtained.

For example, use of a carbon-filled paper with a porosity of 12 CORESTA gave a static burn rate of 4 mm/min but when overwrapped with a paper of porosity 120 CORESTA a burn rate of 5.2 mm/min was obtained. This resulted in a cigarette having two less puffs than the cigarette which has the carbon filled paper, in addition the overwrapped cigarette gave rise to greater sidestream reduction (53%) relative to the cigarette with just the carbon paper (30%).

The tobacco rod can be attached to a filter element and the invention also includes a cigarette incorporating such a smoking material rod.

The cigarette rod and a cigarette incorporating the rod can be made in various ways and the accompanying drawing is a cross-section view through a cigarette incorporating the invention.

As shown in the drawing the cigarette comprises a rod of smoking material, for example, tobacco 1 which is located within an inner wrapper 2 made from a sidestream reducing paper containing carbon. The inner wrapper is enclosed within an overwrapping outer wrapper 3 made from a conventional cigarette paper or from a low sidestream cigarette paper. A conventional filter element 4 made from, for example, cellulose acetate, polypropylene, paper or web materials is attached to the cigarette rod by a tipping paper 5.

A range of cigarette design parameters relating to cigarettes incorporating the invention are set out below.

RANGE OF CIGARETTE PARAMETERS

| PARAMETER | RANGE | PREFERRED VALUES |
|---|---|---|
| Cigarette length (mm) | 50–140 | 60–100 |
| Tobacco rod length (mm) | 40–100 | 50–90 |
| Filter length (mm) | 5–40 | 10–30 |
| Tobacco rod circumference (mm) | 10–30 | 17–25 |
| Tobacco rod density (mg/cc) | 120–300 | 180–275 |
| Inner paper porosity (CORESTA units) | 4–130 | 10–30 |
| Outer paper porosity (CORESTA units) | 4–300 | 20–300 |

Cigarette paper parameters for the invention are also shown as follows.

PAPER SPECIFICATION

| PARAMETER INNER PAPER | RANGE | PREFERRED VALUES |
|---|---|---|
| Basis Weight $g/m^2$ | 20–60 | 35–50 |
| % Carbon in filler | 5–20 | 8–15 |
| % $Mg(OH)_2$ in filler | 5–20 | 6–11 |
| % $CaCO_3$ in filler | 5–20 | 15–20 |
| Porosity (CORESTA units) | 4–130 | 5–20 |

Although the invention is not limited to the particular parameters set out above they provide sufficient details to make cigarettes according to the invention.

If desired the outer wrapper can be impregnated with or incorporate flavour components to improve the flavour of mainstream smoke and the aroma of sidestream smoke. Alternatively this can be achieved, for example, by impregnating the carbon portion of the filler material in the paper or by incorporating a flavour component in the filler materials.

Additionally, irritant reducing and impact enhancing compounds can be added to the filler.

Carbon used in the filler can have a range of surface areas and activities. Typically the surface areas of the carbon used can be in the range of 200 to 2000 $m^2g^{-1}$ with activities (measured by the Carbon Tetrachloride method of absorption) in the range of 20 to 150%.

We claim:

1. A rod of smoking material having an inner wrapper of sidestream reducing paper and an outer overwrapping cigarette paper, said sidestream reducing paper having a basis weight in the range of 35 $g/m^2$ to 50 $g/m^2$, a porosity of between 5 and 20 coresta units, and has a filter content which includes 8% to 15% carbon, 6% to 11% magnesium hydroxide ($Mg(OH)_2$) and 15% to 20% calcium carbonate ($CaCO_3$).

2. A rod of smoking material as claimed in claim 1 in which the outer wrapping is a conventional cigarette paper or a low sidestream cigarette paper.

3. A rod of smoking material as claimed in claim 2 in which the inner wrapper and outer wrapping are of different porosity.

4. A rod smoking material as claimed in claim 1 in which the outer overwrapping is impregnated with or incorporates a flavour component.

5. A rod of smoking material as claimed in claim 1 in which the carbon portion of the filler is impregnated with a flavour component.

6. A rod of smoking material as claimed in claim 1 in which the filler material incorporates a flavour component.

7. A rod of smoking material as claimed in claim 1 in which an irritant reducing compound is added to the filler.

8. A rod of smoking material as claimed in claim 1 in which an impact enhancing compound is added to the filler.

9. A rod of smoking material as claimed in claim 1 in which the surface area of the carbon used in the filler is in the range of 200 to 2000 $m^2g^{-1}$ with activities (measured by the Carbon Tetrachloride method of absorption) in the range of 20% to 150%.

10. A rod of smoking material as claimed in claim 1 which is attached to a filter element.

11. A rod of smoking material having an inner wrapper of sidestream reducing paper and an outer overwrapping cigarette paper, said outer overwrapping cigarette paper being low sidestream cigarette paper, said sidestream reducing paper of said inner wrapper having a basis weight in the range of 35 $g/m^2$ to 50 $g/m^2$, a porosity of between 5 and 20 coresta units, and has a filter content which includes 8% to 15% carbon, 6% to 11% magnesium hydroxide ($Mg(OH)_2$) and 15% to 20% calcium carbonate ($CaCO_3$).

* * * * *